US005918541A

United States Patent [19]

Ahnen

[11] Patent Number: 5,918,541

[45] Date of Patent: Jul. 6, 1999

[54] CHILL ROLL TEMPERATURE CONTROL

[75] Inventor: Christopher Ahnen, Algonquin, Ill.

[73] Assignee: Applied Web Systems, Inc., Elgin, Ill.

[21] Appl. No.: 09/187,541

[22] Filed: Nov. 7, 1998

[51] Int. Cl.[6] ..... B41F 5/04

[52] U.S. Cl. ..... 101/219; 101/483; 101/487

[58] Field of Search ..... 101/487, 488, 101/424.1, 219, 483; 118/60, 69, 101

[56] References Cited

U.S. PATENT DOCUMENTS 5,038,495 8/1991 Jacobs et al. ..... 34/62
5,346,385 9/1994 McAleavey ..... 425/363
5,465,661 11/1995 White ..... 101/219
5,676,754 10/1997 Helms et al. ..... 118/101

*Primary Examiner*—Edgar Burr
*Assistant Examiner*—Dave Ghatt
*Attorney, Agent, or Firm*—Dougals B. White

[57] ABSTRACT

There is described herein a method and apparatus for capturing the heat from the web in a web printing system, storing this heat, and then using it to warm the chill rolls to prevent condensation. Particularly, a heat storage tank is used in conjunction with a chill roll cooling system. During startup, the heat from the web is stored in this tank until the reservoir in the tank reaches a pre-set temperature, at which time the chilled water from the chill system is directed to the chill rolls. At each web stoppage, the water from this heat storage tank is flushed to the chill rolls to keep the chill roll temperature above the condensation temperature.

20 Claims, 3 Drawing Sheets

CHILL ROLL TEMPERATURE CONTROL

BACKGROUND OF THE INVENTION

1. Field of the Invention

The present invention relates generally to the control of the temperature of the web in heat-set web printing. More particularly, this invention relates to the apparatus and process for controlling the web temperature by the use of "chill" rolls.

2. Description of the Prior Art

In heat-set web printing, after the ink is applied to the paper, the web leaves the hot air dryer at a temperature between 230° F. and 280° F. At this stage the ink is still soft and requires immediate cooling before the paper can be processed further. Typically, the cooling of the web has been accomplished by the use of what are called chill rolls; the hot web is caused to traverse a series of two to six hollow steel rollers that are cooled with circulating chilled water.

During normal operation of the printing apparatus, frequent interruptions will occur in the continuity of the web movement. This may result from the expected end of a job or change of printing plates, or it may result from the unexpected break of the web. Regardless of the cause, when such a stoppage occurs the prior art systems often allow the web temperature to fall below the dew point. This causes condensation (often referred to as "sweating") to accumulate on the surface of the rolls, saturating the paper web. The resulting web is weakened and likely to break upon restart of the line.

Attempts to control this condensation or sweating of the chill rolls has included control of the flow of chilled water through the chill rolls during web stoppage. However, the thermal mass of the water already in the chill rolls, as well as the thermal mass of the chill rolls themselves, will still cause the temperature of the surface of the chill rolls to drop below the condensation temperature. To remedy that problem, electric heaters have been used in the prior art during web stoppage to heat the circulating chill water above the condensation temperature. But that system has had only limited success since it takes several minutes to warm the water and the chill rolls to a temperature that is high enough to stop condensation on the chill rolls. Alternatively, a storage tank filled with hot water has been used to flush the chill rolls during the press shutdown. While this system has proved to be faster than the electric heater for a single press shutdown, the tank will inevitably cool too much during frequent stops to be effective.

SUMMARY OF THE INVENTION

Accordingly, it is an objective of this invention to provide a method and apparatus for warming the chill rolls during press shutdown which overcomes the above mentioned deficiencies of the prior art. These and other objects are accomplished with the present invention by capturing the heat from the web, storing it, and then using that stored heat to warm the chill rolls to prevent condensation. This is achieved by use of a heat storage reservoir (tank) in conjunction with a conventional chill roll cooling system. At a press shutdown, the heat from the tank is used to heat the chill rolls, and after restart of the press, the heat from the web is stored in the tank.

Specifically, the apparatus of the present invention includes chill rolls for cooling the web, a chilled fluid source for providing a flow of chilled fluid to the chill rolls, valves for selectively controlling the flow of chilled fluid from the chilled fluid source through the chill rolls, a heat storage fluid reservoir for storing heat recovered from the web, conduits for connecting the heat storage fluid reservoir to the chill rolls to allow flow of fluid therebetween, and a temperature controlled pump for controlling fluid flow between the heat storage fluid reservoir and the chill rolls.

In this web printing system, the method of controlling the temperature of the chill rolls during a press shutdown and during the subsequent press restart, includes the steps of: detecting a press shutdown; providing flow of heated fluid from a heat storage reservoir to the chill rolls in substitution for the chilled fluid; and then storing heat from the web in the heat storage reservoir following press restart until the heat storage reservoir reaches a pre-set temperature.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
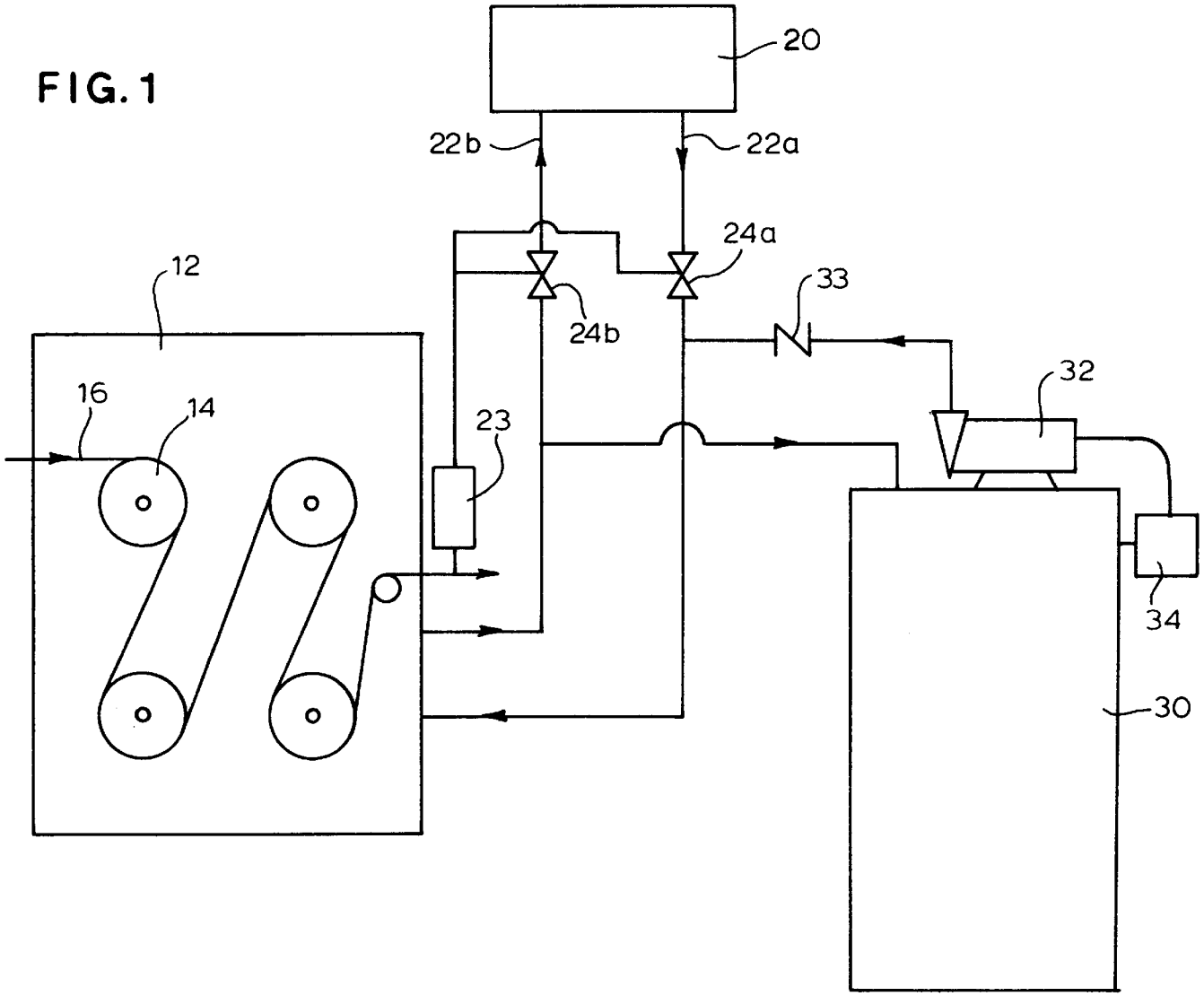
FIG. 1 is diagramatic view of the apparatus for controlling the temperature of the chill rolls.

Turning first to FIG. 1 there is shown a roll stand 12 having positioned therein a series of chill rolls 14 for cooling a web 16 fed across the chill rolls (in a manner well known to the art). During normal press operation, a well known chilled fluid source 20 provides a chilled fluid, such as water, to the series of chill rolls 14 via piping 22*a* and 22*b* to cool the web 16 as it passes over the chill rolls. A web sensor/controller means 23 senses the temperature of the web and controls valve means, such as the valves 24*a* and 24*b*, to provide continuous control of the web temperature during normal press operation by controlling the flow of chilled fluid to the chill rolls.

Upon the occurrence of a press shutdown, the flow of chilled fluid to the chill rolls is stopped by means of the valves 24*a* and 24*b*, and heated fluid from the heat storage reservoir means 30 (such as a water tank) is initiated. Means for selectively controlling this flow of heated fluid to the chill rolls includes selective actuation of pump means 32, which delivers fluid flow via conduit means and check valve 33 to the chill rolls to raise the temperature of the chill rolls above the condensation (dew) point. This heated flow through the chill rolls 14 is maintained during the press shutdown and continued after the press restart until the temperature in the heat storage reservoir recovers to the desired pre-set temperature. When the pre-set temperature is reached in the heat storage reservoir (tank) 30, that temperature is sensed by the reservoir sensor/controller means 34 which turns off the pump 32 to terminate flow from the tank. The flow from the chilled fluid source 20 to the chill rolls is then resumed to cool the web.

Figure 2:
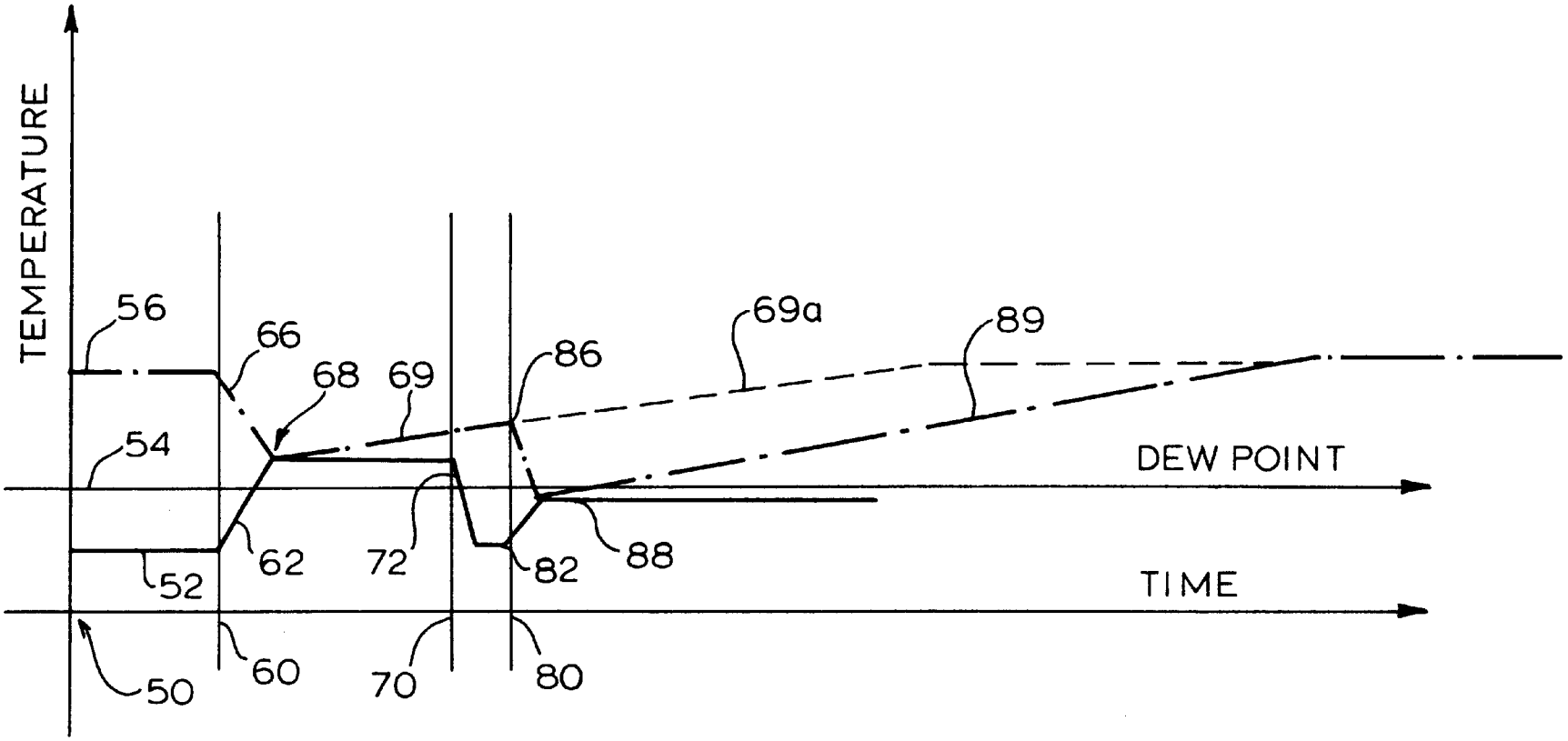
FIG. 2 PRIOR ART
FIG. 2 is a graph showing the performance of the prior art electrically heated hot water tank system.

For a more complete understanding of the invention, reference will now be made to the graph of the performance of a prior art system presented in FIG. 2, in which the horizontal axis represents elapsing time and the vertical axis represents temperature. This particular prior art system includes an electrically heated tank in addition to the usual chilled fluid source for the chill rolls. At the beginning 50 of the time line the system is shown in an equilibrium, with the chill roll temperature 52 below the dew point temperature 54 and the tank temperature 56 elevated above the dew point. At a press shutdown time 60 the heated water from the tank is flushed through the chill rolls, increasing the temperature 62 of the chill rolls and decreasing the temperature 66 of the tank. This temperature gradient continues until an equilibrium temperature 68 is attained, at which time the tank temperature 69 starts to rise again under the effect of the electric heater. (The tank recovery rate is indicated by the upwardly sloping dashed line 69*a*). When the press restarts (at time 70) the cooling of the chill rolls by the chilled fluid source begins, thereby lowering the temperature 72 of the chill rolls back toward their normal operating temperature (below the dew point). At the next press shutdown 80, the chill roll temperature is at the desired operating temperature 82, but the tank temperature 86 will have not recovered sufficiently to provide enough thermal energy to raise the chill rolls above the dew point, and an equilibrium temperature 88 below the dew point results. Subsequent press shutdowns will similarly result in temperatures below the dew point until the tank has had sufficient time to recover along its recovery slope 89.

Figure 3:
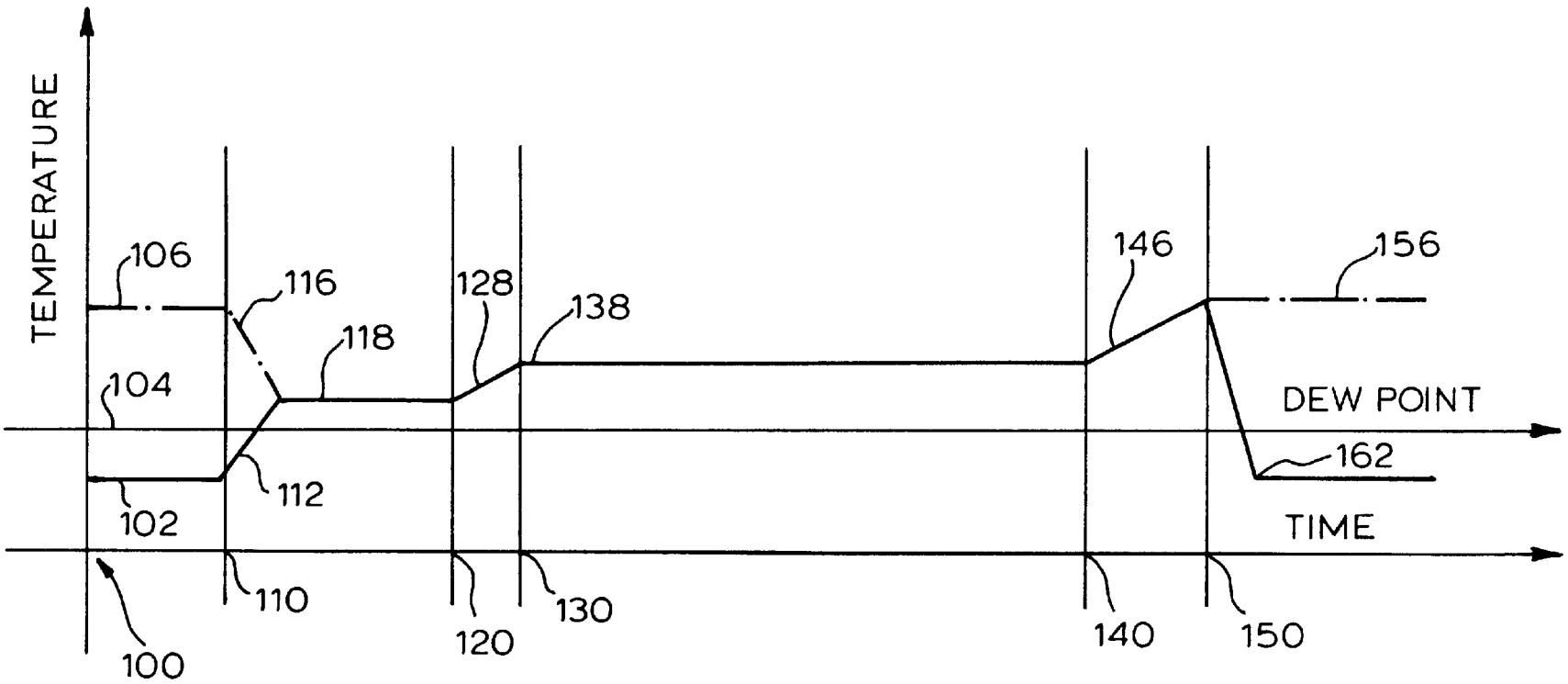
FIG. 3 is a graph showing the performance of the system of the present invention.

In contrast with the prior art system described above, reference is now made to the graph (FIG. 3) of the performance of the present invention. As before, the time is represented on the horizontal axis and the temperature is represented on the vertical axis. At the beginning of the time line 100, the chill rolls are at their cooled temperature 102 below the dew point 104 and the heat storage reservoir (tank) is at its predetermined temperature 106 above the dew point. At the time 110 of press shutdown the temperature 112 of the chill rolls is increased by flushing the tank through the chill rolls, causing the temperature 116 of the tank to fall and causing the temperature of the chill rolls and the tank to reach an equilibrium temperature 118 above the dew point. At the time 120 of press restart, the chilling system is kept off line and the storage tank is kept on line with the chill rolls. As a result, the heat from the web is now caused to be stored in the tank following restart, causing the tank and web temperature 128 to increase together; so that, at the time 130 of another press shutdown, the temperature 138 of the tank and chill rolls are both still above the dew point. Consequently, they will both be above the dew point during this shut down and after the restart at time 140. Following restart, the heat from the tank is again collected in the storage tank, causing the tank temperature 146 to rise with the temperature of the chill rolls. When (at time 150) the temperature of the tank reaches a predetermined temperature 156, the flow to the heat storage tank 30 is terminated and flow of chilled fluid from the chilled fluid source is initiated to reduce the temperature 162 of the chill rolls to the desired normal operating temperature.

From the foregoing description, it will be apparent that modifications can be made to the apparatus and method for using same without departing from the teachings of the present invention. Accordingly, the scope of the invention is only to be limited as necessitated by the accompanying claims.

What is claimed is:

1. Apparatus for the control of the temperature of chill rolls in a web printing system comprising:

one or more chill rolls for cooling the web;

a chilled fluid source for providing a flow of chilled fluid to said chill rolls;

valve means for selectively controlling said flow of chilled fluid from said chilled fluid source through said chill rolls;

heat storage reservoir means for storing heat recovered from the web;

conduit means for connecting said heat storage reservoir means to said chill rolls to allow flow of fluid therebetween; and means for selectively controlling said fluid flow between said heat storage reservoir means and said chill rolls.

2. The apparatus of claim 1 further comprising a web sensor/controller means for sensing the temperature of the web and controlling said flow of fluid from said chilled fluid source to said chill rolls.

3. The apparatus of claim 1 further comprising a reservoir sensor/controller means for sensing the temperature of said heat storage reservoir means and controlling said flow of fluid between said heat storage reservoir means and said chill rolls.

4. The apparatus of claim 3 further comprising pump means for causing flow of fluid from said heat storage reservoir means to said chill rolls.

5. The apparatus of claim 4 wherein said reservoir sensor/controller means controls said pump means.

6. The apparatus of claim 5 further comprising a web sensor/controller means for sensing the temperature of the web and controlling said flow of fluid from said chilled fluid source to said chill rolls.

7. In a web printing system of the type employing one or more chill rolls for cooling the web and a chilled fluid source for providing a flow of chilled fluid to the chill rolls, the improvement comprising;

heat storage reservoir means for storing heat recovered from the web;

conduit means for connecting said heat storage reservoir means to said chill rolls to allow fluid flow therebetween; and means for selectively controlling said fluid flow between said heat storage reservoir means and the chill rolls.

8. The apparatus of claim 7 further comprising a web sensor/controller means for sensing the temperature of the web and controlling said flow of fluid from said chilled fluid source to said chill rolls.

9. The apparatus of claim 7 further comprising a reservoir sensor/controller means for sensing the temperature of said heat storage reservoir means and controlling said flow of fluid between said heat storage reservoir means and said chill rolls.

10. The apparatus of claim 9 further comprising pump means for causing flow of fluid from said heat storage reservoir means to said chill rolls.

11. The apparatus of claim 10 wherein said reservoir sensor/controller means controls said pump means.

12. The apparatus of claim 11 further comprising a web sensor/controller means for sensing the temperature of the web and controlling said flow of fluid from said chilled fluid source to said chill rolls.

13. In a web printing system having chill rolls and a chilled fluid system, a method of controlling the temperature of the chill rolls during a press shutdown and during the subsequent press restart, the method comprising the steps of:

detecting a press shutdown;

providing flow of heated fluid from a heat storage reservoir to the chill rolls in substitution for the chilled fluid; and storing heat from the web in said heat storage reservoir following press restart.

14. The method of claim 13 further comprising the step of continuing to store heat from the web in said heat storage reservoir until the temperature of said heat storage reservoir reaches a predetermined temperature.

15. The method of claim 13 further comprising providing heated fluid from said heat storage reservoir by selective actuation of a pump.

16. The method of claim 15 further comprising controlling said pump with a temperature sensing controller.

17. The method of claim 13 wherein said step of storing heat in said heat storage reservoir comprises continuing to provide said flow of fluid from said heat storage reservoir to the chill rolls.

18. The method of claim 17 further comprising the step of continuing to store heat from the web in said heat storage reservoir until the temperature of said heat storage reservoir reaches a predetermined temperature.

19. The method of claim 17 further comprising providing heated fluid from said heat storage reservoir by selective actuation of a pump.

20. The method of claim 19 further comprising controlling said pump with a temperature sensing controller.

* * * * *